US010471612B2

(12) United States Patent
Shimizu

(10) Patent No.: US 10,471,612 B2
(45) Date of Patent: Nov. 12, 2019

(54) ROTARY ELECTRIC SHAVER AND METHOD OF MANUFACTURING INNER BLADE OF ROTARY ELECTRIC SHAVER

(71) Applicant: Izumi Products Company, Matsumoto-shi, Nagano (JP)

(72) Inventor: Tetsuhiko Shimizu, Matsumoto (JP)

(73) Assignee: MAXELL IZUMI CO., LTD., Matsumoto-Shi, Nagano (JP)

( * ) Notice: Subject to any disclaimer, the term of this patent is extended or adjusted under 35 U.S.C. 154(b) by 0 days.

(21) Appl. No.: 15/265,421

(22) Filed: Sep. 14, 2016

(65) Prior Publication Data

US 2017/0144317 A1 May 25, 2017

(30) Foreign Application Priority Data

Nov. 24, 2015 (JP) ..... 2015-229097

(51) Int. Cl.
*B26B 19/14* (2006.01)
*B26B 19/38* (2006.01)

(52) U.S. Cl.
CPC ..... *B26B 19/141* (2013.01); *B26B 19/146* (2013.01); *B26B 19/3893* (2013.01)

(58) Field of Classification Search
CPC ..... B26B 19/14; B26B 19/141; B26B 19/143; B26B 19/145; B26B 19/146
USPC ..... 30/43, 43.4–43.6
See application file for complete search history.

(56) References Cited

U.S. PATENT DOCUMENTS 3,125,808 A * 3/1964 Starre ..... B26B 19/141 30/225
3,261,091 A * 7/1966 Van Den Driest .... B26B 19/141 30/346.57
4,168,570 A 9/1979 Bakker et al.
4,283,849 A * 8/1981 Engelhardt ..... B26B 19/42 30/43.6

(Continued)

FOREIGN PATENT DOCUMENTS

CN 2700070 Y 5/2005
JP 53-134559 11/1978

(Continued)

OTHER PUBLICATIONS

European Office Action dated Apr. 16, 2019 for Application No. 16 200 027.7.

(Continued)

*Primary Examiner* — Jason Daniel Prone
*Assistant Examiner* — Richard D Crosby, Jr.
(74) *Attorney, Agent, or Firm* — Birch, Stewart, Kolasch & Birch, LLP

(57) ABSTRACT

A rotary electric shaver according to the present invention includes an outer blade whose upper surface functions as annular shaving surfaces having multiple hair inlets formed therein, and an inner blade that has a small blade which rotates while coming into sliding contact with a lower surface of the outer blade. The inner blade is an integral structure using a metal material, and has a projection in which an upper surface side is a convex portion and a lower surface side is a concave portion at a center position in a radial direction. An upper end portion of an inner blade drive shaft directly engages with the concave portion so as to be disengageable therefrom.

6 Claims, 7 Drawing Sheets

(56) References Cited

U.S. PATENT DOCUMENTS 4,882,840 A * 11/1989 Tietjens ..... B26B 19/141 30/346.51
D355,276 S * 2/1995 Uchiyama ..... D28/50
5,909,928 A * 6/1999 Barish ..... B26B 19/14 30/34.05
6,502,309 B2 * 1/2003 De Vries ..... B26B 19/141 30/34.2
6,769,179 B2 * 8/2004 Satoh ..... B26B 19/04 30/346.51
6,868,611 B2 * 3/2005 Geertsma ..... B26B 19/143 30/346.51
6,952,879 B2 * 10/2005 Okabe ..... B26B 19/141 30/346.51
7,152,324 B2 * 12/2006 Uchiyama ..... B26B 19/14 30/43.6
7,178,242 B2 * 2/2007 Okabe ..... B26B 19/141 30/346.51
7,530,171 B2 * 5/2009 Baron ..... B26B 19/14 30/205
8,061,040 B2 * 11/2011 Walls ..... B26B 19/14 30/43
8,151,467 B2 * 4/2012 Wllem ..... B26B 19/141 30/346.51
8,191,264 B2 * 6/2012 Veenstra ..... B26B 19/141 30/346.51
8,220,157 B2 * 7/2012 Shimizu ..... B26B 19/145 30/43.4
8,230,601 B2 * 7/2012 Shimizu ..... B26B 19/145 30/43.4
8,336,211 B2 * 12/2012 De Wit ..... B26B 19/141 30/43.4
8,393,082 B2 * 3/2013 Shimizu ..... B26B 19/14 30/43.5
8,397,604 B2 * 3/2013 Akkerman ..... B21D 53/64 30/436
8,434,233 B2 * 5/2013 Okabe ..... B26B 19/141 30/346.51
8,806,762 B2 * 8/2014 Blaauw ..... B26B 19/044 30/346.51
8,857,063 B2 * 10/2014 Koike ..... B26B 19/145 30/43.4
9,027,251 B2 * 5/2015 Schmitt ..... B26B 19/14 30/41
9,555,551 B2 * 1/2017 Campbell ..... B26B 19/141
9,789,616 B2 * 10/2017 Mimura ..... B26B 19/141
9,827,684 B2 * 11/2017 Van Toor ..... B26B 19/3853
2004/0078985 A1 * 4/2004 Chen ..... B26B 19/141 30/346.51
2005/0257376 A1 * 11/2005 De Wit ..... B26B 19/141 30/43.4
2007/0089298 A1 * 4/2007 Shimizu ..... B26B 19/14 30/43.6
2007/0113408 A1 * 5/2007 Okabe ..... B26B 19/141 30/43.6
2007/0124936 A1 * 6/2007 Okabe ..... B26B 19/14 30/43.6
2007/0256302 A1 * 11/2007 Okabe ..... B26B 19/141 30/43.6
2007/0277379 A1 * 12/2007 Okabe ..... B26B 19/14 30/43.92
2008/0172881 A1 * 7/2008 Okabe ..... B26B 19/141 30/43.6
2012/0110853 A1 * 5/2012 Mimura ..... B26B 19/143 30/43.5
2012/0110854 A1 * 5/2012 Nakano ..... B26B 19/143 30/43.5
2013/0145627 A1 * 6/2013 Murzynski ..... B26B 19/141 30/43.5
2015/0224654 A1 * 8/2015 Steur ..... B26B 19/14 30/43.6
2016/0089799 A1 * 3/2016 Mimura ..... B26B 19/143 30/43.6
2017/0144317 A1 * 5/2017 Shimizu ..... B26B 19/141

FOREIGN PATENT DOCUMENTS

JP 2008-154736 A 7/2008
JP 2015-70927 A 4/2015
WO WO 96/26046 A1 8/1996

OTHER PUBLICATIONS

Chinese Office Action and Search Report for Chinese Application No. 201611010435.X, dated Feb. 2, 2019, with English translation of the Office Action.

* cited by examiner

ROTARY ELECTRIC SHAVER AND METHOD OF MANUFACTURING INNER BLADE OF ROTARY ELECTRIC SHAVER

CROSS-REFERENCE TO RELATED APPLICATION

This application is based upon and claims the benefit of priority of the prior Japanese Patent Application No. P2015-229097, filed on Nov. 24, 2015, and the entire contents of which are incorporated herein by reference.

FIELD

The present invention relates to a rotary electric shaver and a method of manufacturing an inner blade of a rotary electric shaver.

BACKGROUND

In the related art, a rotary electric shaver is known which cuts hair entering multiple hair inlets while including an outer blade whose upper surface functions as an annular shaving surface having the multiple hair inlets formed therein and an inner blade that has a small blade which rotates while coming into sliding contact with a lower surface of the outer blade (refer to PTLS 1 and 2). In this invention, examples of the hair include beards, mustaches, whiskers, and the like.

CITATION LIST

Patent Literature

PTL 1: JP-A-2015-070927
PTL 2: JP-A-2008-154736

SUMMARY OF INVENTION

Technical Problem

However, according to the rotary electric shaver in the related art as disclosed in PTLS 1 and 2, as illustrated in FIG. 2 in PTL 1 and FIG. 3 in PTL 2, a rotatably driven inner blade assembly is configured to include at least two components such as an inner blade formed of a metal material and an inner blade holder formed of a resin material. Therefore, there is a problem of increasing cost for components and assembly work. Furthermore, the above-described two components are combined with each other in an axial direction so as to configure the inner blade assembly. Consequently, a height dimension in the axial direction inevitably increases, thereby causing a problem in that the rotary electric shaver is less likely to have a compact size.

The present invention is made in view of the above-described circumstances, and an object thereof is to provide a rotary electric shaver and a method of manufacturing an inner blade of a rotary electric shaver, which can realize a configuration employing a rotatably driven member as a single component having only an inner blade formed of a metal material, and which can decrease cost for components and assembly work and can achieve a compact size.

Solution to Problem

The object may be realized by providing embodiments disclosed hereinafter.

A rotary electric shaver disclosed herein includes an outer blade whose upper surface functions as annular shaving surfaces having multiple hair inlets formed therein, and an inner blade that has a small blade which rotates while coming into sliding contact with a lower surface of the outer blade from below the annular shaving surfaces. The inner blade is an integral structure using a metal material, and has a projection in which an upper surface side is a convex portion and a lower surface side is a concave portion at a center position in a radial direction. An upper end portion of an inner blade drive shaft directly engages with the concave portion so as to be disengageable therefrom.

In addition, a disclosed method of manufacturing an inner blade of a rotary electric shaver including an outer blade whose upper surface functions as annular shaving surfaces having multiple hair inlets formed therein, and an inner blade that has a small blade which rotates while coming into sliding contact with a lower surface of the outer blade from below the annular shaving surfaces. The method includes carrying out press work for a flat plate formed of a metal material subjected to press-punching into a predetermined shape, and processing the flat plate into a shape including the multiple small blades erected from a plate surface of the flat plate at a predetermined angle, and a projection that has a substantially polygonal shape in a plan view, in which an upper surface side is a convex portion and a lower surface side is a concave portion at a center position in a radial direction of the flat plate, and that has a through-hole at the center position in the radial direction.

Advantageous Effects

According to the present invention, an inner blade assembly configured to include at least two components in the related art can be configured to include a single component of only an inner blade. Therefore, the configuration can be simplified, and component cost and assembly cost can be decreased. In addition, compared to the configuration in the related art, a height dimension in an axial direction can be minimized. Therefore, in particular, a head unit for accommodating the inner blade can be formed so as to have a compact size, and a configuration can be more freely designed.

In addition, the inner blade having the above-described characteristic configuration is manufactured (formed) by carrying out press work. Accordingly, it is possible to simplify a manufacturing process and to decrease manufacturing cost.

DESCRIPTION OF EMBODIMENTS

First Embodiment

Figure 1:
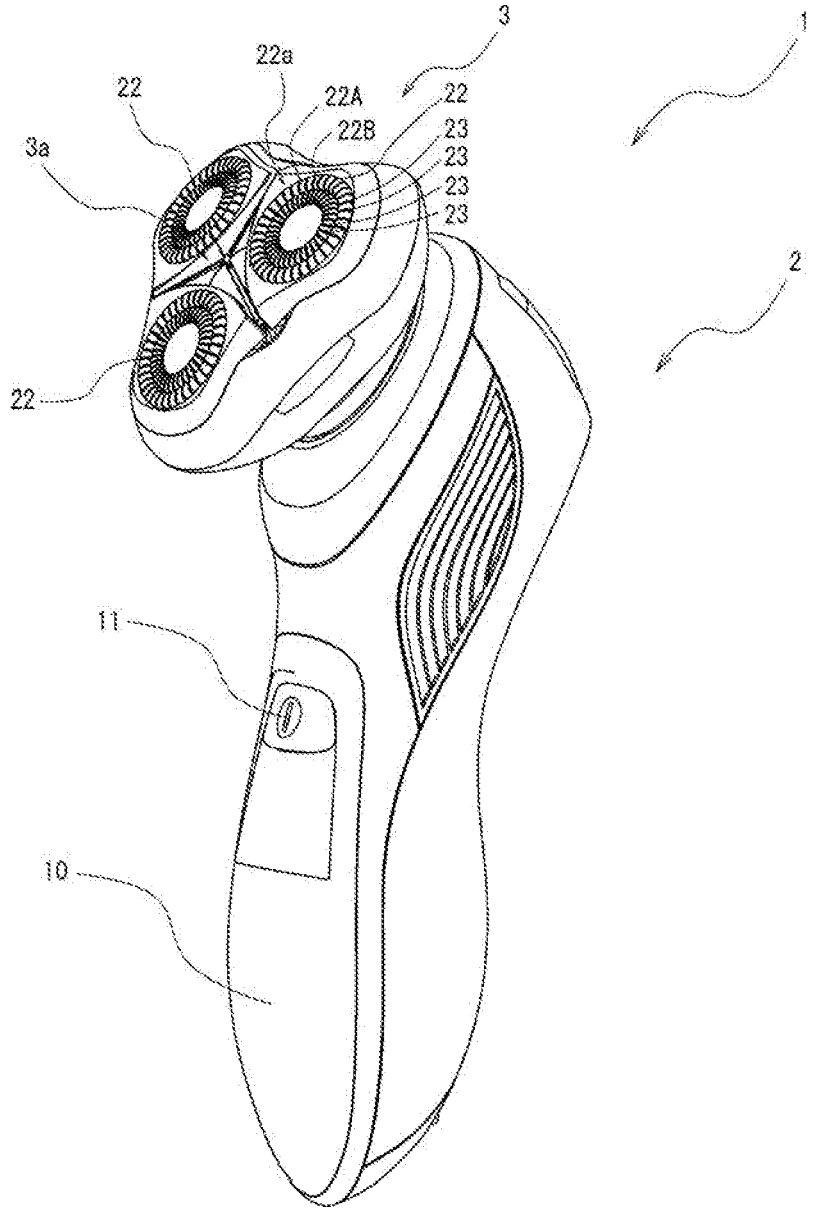
FIG. 1 is a schematic view (perspective view) illustrating an example of a rotary electric shaver according to a first embodiment of the present invention.
Figure 2:
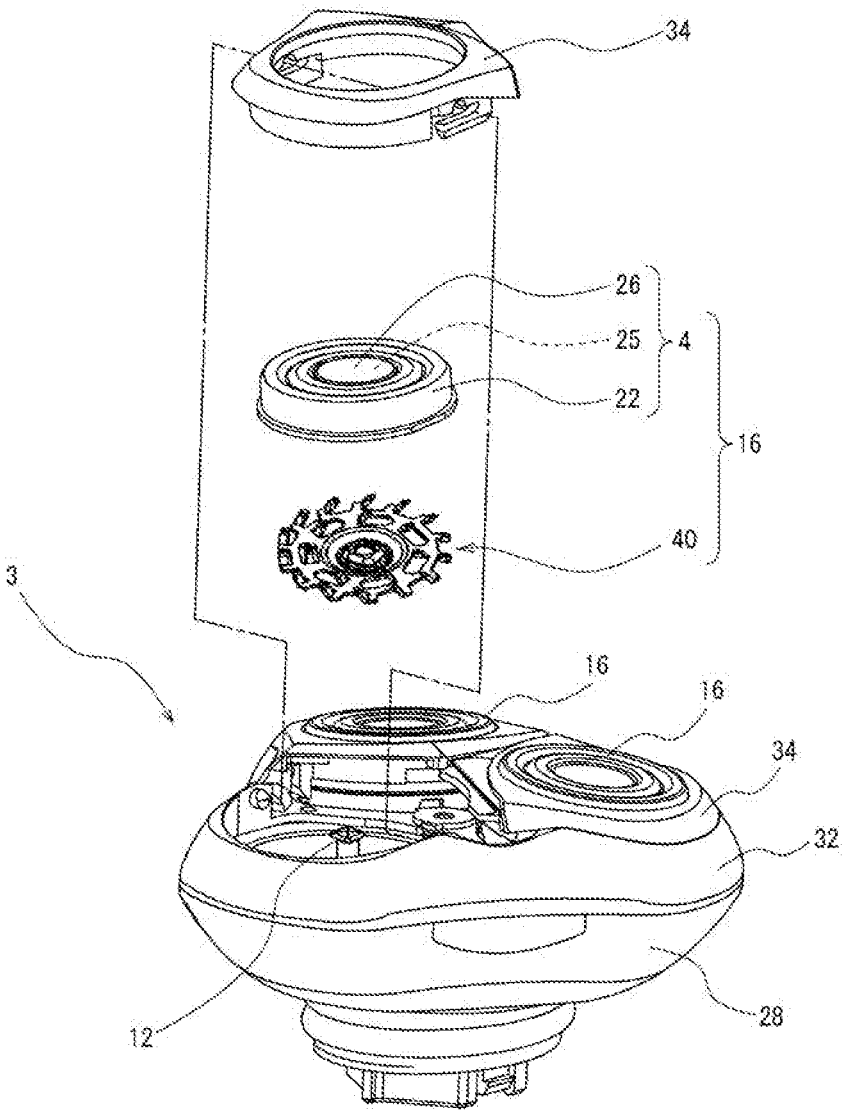
FIG. 2 is a schematic view (exploded perspective view) illustrating an example of a head unit of the rotary electric shaver illustrated in FIG. 1.
Figure 3:
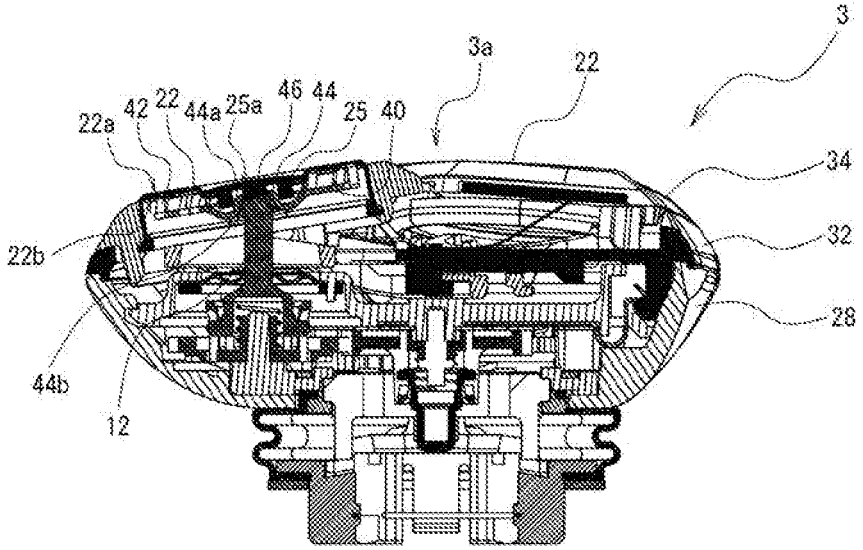
FIG. 3 is a schematic view (side sectional view) illustrating an example of the head unit of the rotary electric shaver illustrated in FIG. 1.

Hereinafter, referring to the drawings, a first embodiment according to the present invention will be described in detail. FIG. 1 is a perspective view (schematic view) illustrating an example of a rotary electric shaver 1 according to the first embodiment of the present invention. In addition, FIG. 2 is an exploded perspective view (schematic view) illustrating an example of a head unit 3 of the rotary electric shaver 1 illustrated. FIG. 3 is a side sectional view (schematic view) illustrating an example of the head unit 3. Referring to all drawings used in describing the embodiments, the same reference numerals will be given to members having the same function, and repeated description thereof will be omitted in some cases.

As illustrated in FIGS. 1 to 3, the rotary electric shaver 1 according to the present embodiment is configured so that the head unit 3 held in a main body 2 includes an outer blade 22 whose upper surface 22*a* functions as annular shaving surfaces (as an example, 22A and 22B) having multiple hair inlets 23 formed therein, and an inner blade 40 that has a small blade 42 which comes into sliding contact with a lower surface 22*b* of the outer blade 22. A configuration is adopted in which the inner blade 40 is rotatably driven so as to cut the hair entering the hair inlets 23 by using the outer blade 22 and the inner blade 40. In the present embodiment, an example will be described in which the rotary electric shaver has three sets of a blade unit 16 configured to include an outer blade assembly 4 having the outer blade 22, and the inner blade 40. However, the present invention is not limited thereto. In addition, a configuration may be adopted in which the outer blade is also rotatably driven together with the inner blade (not illustrated).

The main body 2 includes a substantially cylindrical case 10. A drive source (as an example, a motor), a battery, and a control circuit board (all not illustrated) are accommodated inside the case 10. In addition, a power switch 11 is attached to a front surface of the case 10.

The head unit 3 illustrated in FIGS. 2 and 3 includes a head case 28 which is held by being connected to an upper portion of the case 10 in the main body 2, an outer blade frame 32 which is fitted to the head case 28 from above, an inner blade drive shaft 12 which is accommodated in an inner bottom portion of the head case 28, and three sets of the blade unit 16 which are held in the outer blade frame 32 so as to be slightly and vertically movable and swingable. In addition, three sets of the blade unit 16 are arranged so as to form a triangle in a plan view. As described above, the present embodiment employs a case example where three sets of the blade unit 6 are included therein. However, a basic configuration may be similarly conceivable even in a case where blade units are included in an alternative combination other than three sets.

Figure 4:
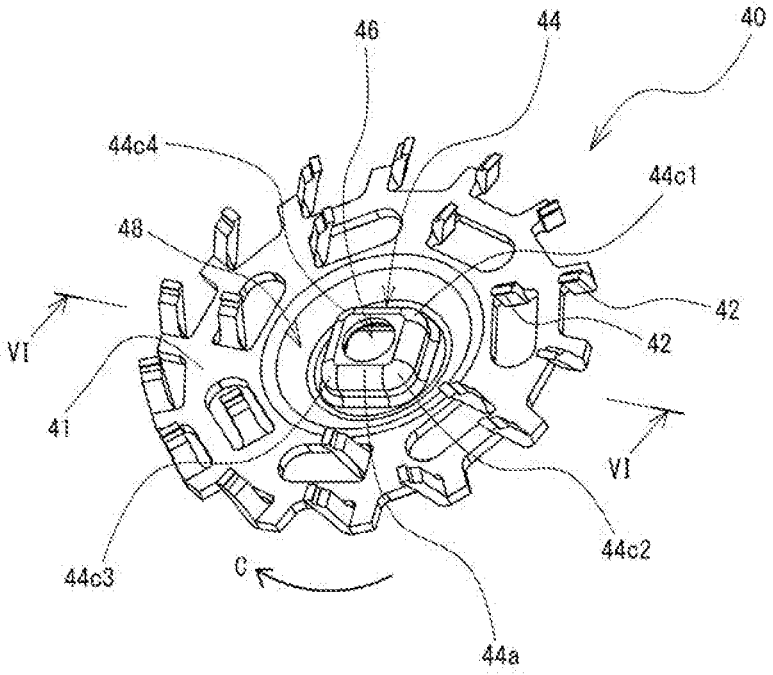
FIG. 4 is a schematic view (upper surface side perspective view) illustrating an example of an inner blade of the rotary electric shaver illustrated in FIG. 1.
Figure 5:
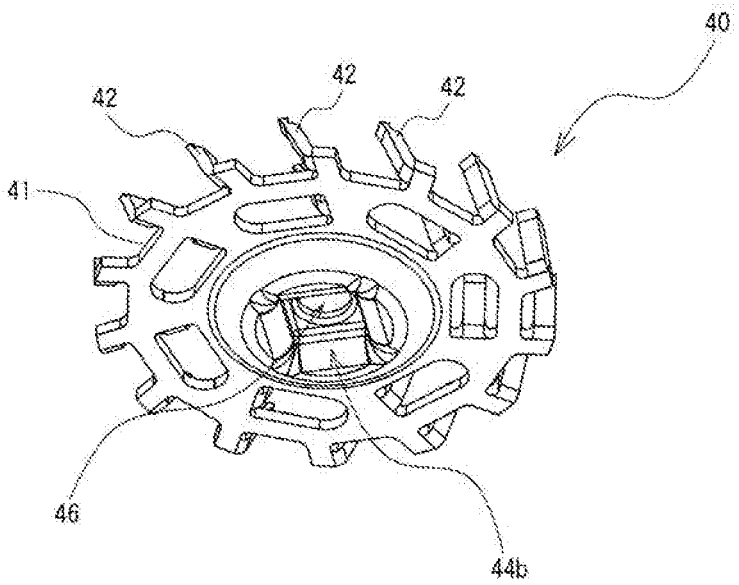
FIG. 5 is a schematic view (lower surface side perspective view) illustrating an example of the inner blade of the rotary electric shaver illustrated in FIG. 1.
Figure 6:
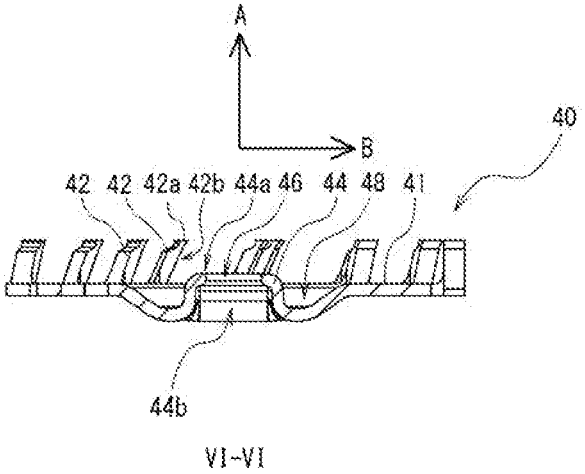
FIG. 6 is a sectional view taken along line VI-VI in FIG. 4.

First, a configuration of the inner blade 40 in the blade unit 16 will be described with reference to FIGS. 4 to 6. Here, FIG. 4 is an upper surface side perspective view (schematic view) illustrating an example of the inner blade 40. FIG. 5 is a lower surface side perspective view (schematic view) thereof. FIG. 6 is a front sectional view (schematic view) taken along line VI-VI in FIG. 4. Here, referring to FIGS. 4 and 6, an axial direction of the inner blade 40 represents a direction of an arrow A, a radial direction represents a direction of an arrow B, and a circumferential direction represents a direction of an arrow C. The direction of the arrow C is aligned with a rotation direction of the inner blade 40.

The inner blade 40 according to the present embodiment has a configuration in which a rotor which is rotatably driven by the inner blade drive shaft 12 includes a single component of only the inner blade 40. In the present embodiment, the inner blade 40 is formed as an integral structure in such a way that a flat plate-shaped metal material made of a stainless steel alloy is subjected to processing such as die-cutting, squeezing, and bending through press work (details will be described later).

Whereas the inner blade assembly in the related art disclosed in PTLS 1 and 2 is configured to include at least two components such as the inner blade and the inner blade holder, the above-described rotor according to the present embodiment can be configured to include only the inner blade 40 serving as a single component. In this manner, with regard to the number of components in the above-described rotor, the configuration including multiple components in the related art can be replaced with a configuration including a single component. Accordingly, it is possible to eliminate a process for assembling the multiple components and assembly equipment required for the process. In addition, it is possible to omit a resin component (inner blade holder in the related art). Accordingly, a mold needed to manufacture the resin component is no longer required. Therefore, it is possible to greatly decrease both component cost and manufacturing cost.

In addition, whereas a height (dimension in the axial direction) of the inner blade assembly in the related art is inevitably increased due to the configuration including two components, according to the present embodiment, the above-described rotor can be configured to include only the inner blade. Accordingly, it is possible to minimize the dimension in the height direction (axial direction). Therefore, in particular, it is possible to miniaturize a size of the head unit 3 for accommodating the inner blade 40. Furthermore, the configuration can be more freely designed, and compact and stylish design can be realized.

In addition, the inner blade 40 is configured to include the multiple small blades 42 in which an inner blade base plate 41 having a substantially disc-shaped flat plate is partially erected from a plate surface (in order to simplify the drawings, the reference numerals are given to only a few of the small blades). As an example, the small blade 42 is formed so that a front end surface 42*b* tilts forward in the rotation direction. Therefore, a front side upper end edge in the rotation direction functions as a blade edge 42*a*.

The inner blade 40 according to the present embodiment adopts a so-called dual track configuration in which the small blades 42 are disposed in two rows on a circumference close to an outer periphery and on a circumference close to an inner periphery. However, without being limited thereto, Other configurations, such as triple tracks in which the small blades 42 are disposed in three rows, may be adopted.

The small blade 42 according to the present embodiment is formed so that the widths in the radial direction from the upper end to the lower end are equal. As an example, the small blade 42 has a substantially prismatic shape having a rectangular cross section in which the width in the radial direction is approximately 1 mm and the width in the circumferential direction is approximately 0.5 mm. The small blade 42 is formed so that the length (length from the base to the blade edge) is approximately 3 mm. However, the dimensional shape is not limited thereto.

Here, as a characteristic configuration according to the present embodiment, the inner blade 40 has a projection 44 in which an upper surface side is a convex portion 44*a* and a lower surface side is a concave portion 44*b* in a center position in the radial direction.

First, the convex portion 44*a* is internally fitted into a cylindrical portion 25*a* disposed on a lower surface side of an outer blade cover 25 of the outer blade assembly 4 (to be described later). Accordingly, it is preferable that the convex portion 44*a* has three or more corner portions which come into sliding contact with an inner wall of the cylindrical portion 25*a*. In this case, the convex portion 44*a* can be positioned without being shaken in the radial direction. Compared to a case of coming into surface contact with the inner wall, contact resistance decreases. Therefore, it is possible to reduce power consumption.

As an example, the projection 44 is formed in a substantially square shape in a plan view. Therefore, the convex portion 44*a* is formed in a substantially square shape in a plan view, and is formed in a shape having four corner portions 44*c*1, 44*c*2, 44*c*3, and 44*c*4. At the same time, the concave portion 44*b* is also formed in a substantially square shape in a plan view (bottom view). However, a configuration of the projection 44 is not limited thereto. The projection 44 may be formed in a substantially triangular shape in a plan view or in a substantially polygonal shape, for example, such as at least a substantially pentagonal shape. Therefore, in response to the shape of the projection 44, the convex portion 44*a* and the concave portion 44*b* can also employ various shapes. All of these are formed through press work. Accordingly, the above-described polygonal corner portion has a shape having a predetermined curvature rather than an angular shape.

Here, the inner blade 40 according to the present embodiment is configured by forming a recessed portion 48 in which a plate surface of the inner blade base plate 41 is recessed toward the lower surface side in the center portion in the radial direction, and by further forming the projection 44 which is erected toward the upper surface side from the center portion of the recessed portion 48. According to this configuration, the concave portion 44*b* can be formed more deeply (that is, so as to increase the dimension in the axial direction). Accordingly, even in a case where the inner blade 40 is tilted (swings), it is possible to reliably prevent a possibility that an upper end portion 12*a* of the inner blade drive shaft 12 to engage with the concave portion 44*b* may escape (being detached) from the concave portion 44*b* and a drive force may not be transmitted therebetween. Furthermore, an upper end position of the convex portion 44*a* can be arranged at a position lower than an upper end position of the small blade 42. Accordingly, the upper end position of the small blade 42 can be formed to be low (that is, so as to decrease the dimension in the height direction). Therefore, not only the blade unit 16 but also the head unit 3 can have a compact size.

Figure 8:
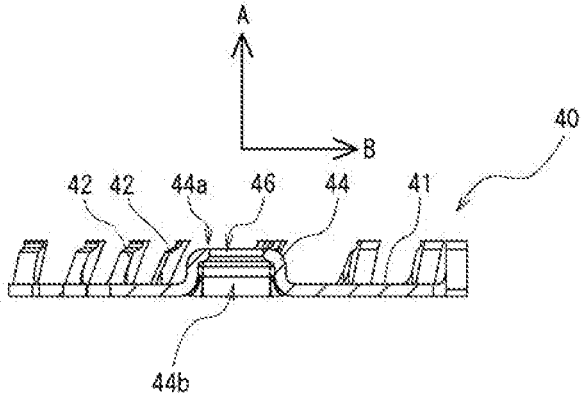
FIG. 8 is a schematic view (front sectional view) illustrating a modification example of the inner blade of the rotary electric shaver illustrated in FIG. 1.

As a modification example of the inner blade 40, a configuration may be adopted in which the recessed portion is not disposed on the plate surface as illustrated by the front sectional view (schematic view) in FIG. 8.

Figure 7:
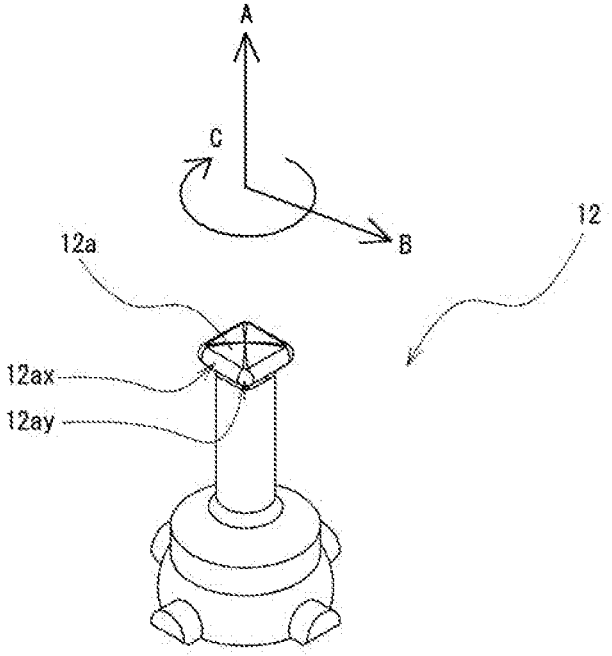
FIG. 7 is a schematic view (upper surface side perspective view) illustrating an example of an inner blade drive shaft of the rotary electric shaver illustrated in FIG. 1.

On the other hand, the upper end portion 12*a* (refer to FIG. 7) of the inner blade drive shaft 12 directly engages with the concave portion 44*b* so as to be disengageable therefrom and swingable, thereby transmitting the drive force. The upper end portion 12*a* includes side portions 12*ax* and corner portions 12*ay*. Here, the inner blade drive shaft 12 is a member for rotatably driving the inner blade 40 by transmitting the drive force from a drive source (motor). The inner blade drive shaft 12 according to the present embodiment adopts a configuration in which an internally equipped coil spring is compressed so as to generate a returning tendency in an extending direction thereof. The returning tendency functions as a pressing force of the inner blade 40 against the outer blade 22.

Therefore, the inner blade drive shaft 12 according to the present embodiment is formed in a shape in which the upper end portion 12*a* can engage with and disengage from (can enter and exit from) the concave portion 44*b*, and in which both of these are mutually immovable so as to be fixed in the circumferential direction, that is, so that the drive force can be transmitted therebetween when both of these engage with each other. More specifically, the upper end portion 12*a* of the inner blade drive shaft 12 is formed in a substantially square shape in a plan view so as to be internally fitted into the concave portion 44*b* formed in a substantially square groove shape in a plan view (bottom view).

Here, as illustrated in FIG. 3, a configuration is adopted in which the inner blade 40 and the inner blade drive shaft 12 engage with each other in a state where both center axes are mutually tilted (state having an angle), and in which the tilted angle is changed when in use. Therefore, the upper end portion 12*a* of the inner blade drive shaft 12 is formed in a substantially square flat plate shape which has a curvature in a side portion 12*ax* in an axial direction A and which has a curvature in a corner portion 12*ay* in the axial direction A and a circumferential direction C. According to this configuration, even in a case where both of these engage with each other in a state of being mutually tilted and the tilted angle is changed, the engagement state therebetween can be maintained so as to prevent non-transmission of the rotation drive force. In addition, compared to the configuration of the inner blade drive shaft whose upper end portion is a substantially spherical shape as in the related art (refer to FIG. 2 in PTL 1), a dimension in the axial direction can have the more compact size.

Figure 9:
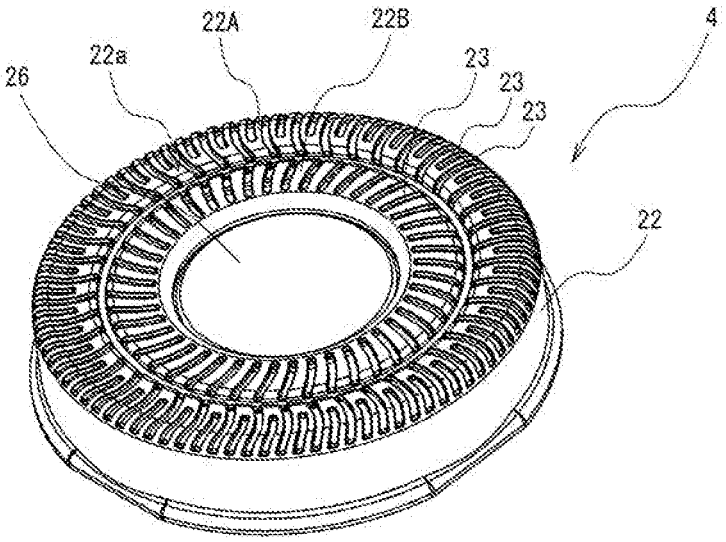
FIG. 9 is a schematic view (upper surface side perspective view) illustrating an example of an outer blade assembly of the rotary electric shaver illustrated in FIG. 1.
Figure 10:
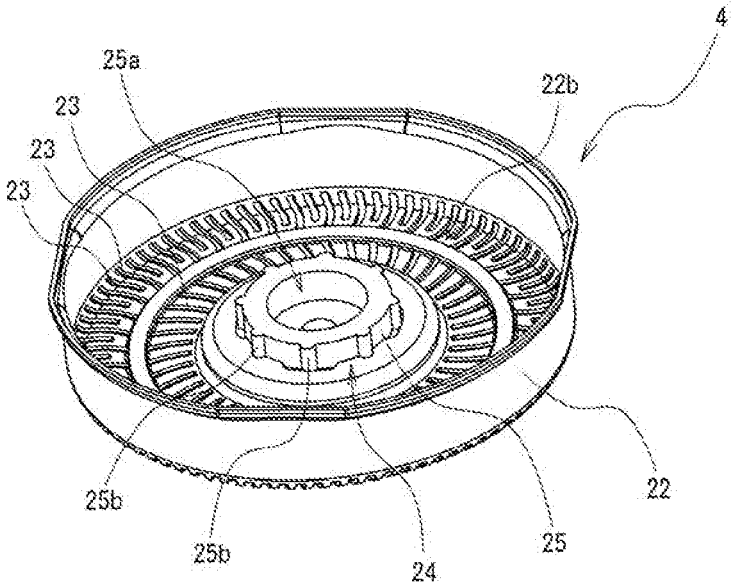
FIG. 10 is a schematic view (lower surface side perspective view) illustrating an example of the outer blade assembly of the rotary electric shaver illustrated in FIG. 1.

Subsequently, the outer blade assembly 4 will be described. The outer blade assembly 4 according to the present embodiment adopts a configuration in which the outer blade cover 25 is fixed to the center of the outer blade 22. Here, FIG. 9 is an upper surface side perspective view (schematic view) illustrating an example of the outer blade assembly 4. FIG. 10 is a lower surface side perspective view (schematic view) thereof. In addition, the inner blade 40 and the outer blade assembly 4 are embedded as illustrated in FIG. 3.

In the present embodiment, the outer blade 22 is formed as an integral structure in such a way that a flat plate-shaped metal material made of a stainless steel alloy is subjected to processing such as die-cutting, squeezing, and bending through press work. The outer blade 22 has a substantially cup shape whose peripheral edge is bent downward. In addition, the multiple hair inlets 23 are formed on the upper surface 22*a* (that is, penetrating from the upper surface 22*a* through the lower surface 22*b*). In this manner, an operation for cutting the hair entering the hair inlets 23 can be performed by interposing the hair between the lower end portion of the hair inlets 23 and the inner blade 40 (small blade 42). The hair inlets 23 can employ various shapes such as a radially slit shape and a round hole shape, or a combination thereof.

On the other hand, as illustrated in FIG. 10, the outer blade cover 25 is formed in a substantially cup shape by using a resin material, and a lower portion thereof has the cylindrical portion 25*a* with which the convex portion 44*a* of the projection 44 of the inner blade 40 engages. In addition, multiple projection portions 25*b* to be fitted and fixed by caulking to a fitting hole 24 formed at the center in the radial direction of the outer blade 22 are disposed on an outer wall portion of the cylindrical portion 25*a*. In this manner, in a state where the center of the outer blade 22 is aligned with the center of the outer blade cover 25 (here, the cylindrical portion 25*a*), both of these are fitted to each other, thereby configuring the outer blade assembly 4. A decorative plate 26 made of a metal material such as a stainless steel alloy is fitted to an upper portion of the outer blade cover 25. However, a configuration may be adopted by omitting the decorative plate 26.

When being assembled, the projection 44 (convex portion 44*a*) of the inner blade 40 is internally fitted from below into the cylindrical portion 25*a* formed at the center in the radial direction on the lower surface side of the outer blade cover 25. In this manner, in a state where the center of the inner blade 40 is aligned with the center of the outer blade cover 25, both of these are restrained from moving in the radial direction (positioned), and are fitted to each other. Therefore, in a state where the center of the inner blade 40 is aligned with the center of the outer blade assembly 4, both of these are restrained from moving in the radial direction (positioned), and are fitted to each other. The inner blade 40 is rotatable with respect to the outer blade assembly 4. However, in this case, the inner blade 40 is movable in the vertical direction with respect to the outer blade cover 25.

In a state where the inner blade 40 and the outer blade assembly 4 are fitted to each other in this way, the outer blade case 34 is fitted thereto from above, and is fixed to (held in) the outer blade frame 32 so as to be swingable and vertically movable. In this case, the upper end portion 12*a* of the inner blade drive shaft 12 engages from below with the concave portion 44*b* disposed in the lower portion of the inner blade 40, and the inner blade 40 is rotatably driven by driving the inner blade drive shaft 12.

In addition, in the present embodiment, the respective outer blade cases 34 are configured to be respectively swingable with respect to the outer blade frame 32 in a seesaw-like manner while both of these are interlocked to each other. In this manner, the upper surface 3*a* of the head unit 3 is deformable between a convex surface state and a concave surface state.

Subsequently, a method of manufacturing the inner blade 40 according to the present embodiment will be described.

First, a thin flat plate material made of a stainless steel alloy (as an example, the thickness of 0.5 mm) is prepared, the front surface side of the plate material is subjected to press-punching through press work (shearing press work) so as to form a substantially disc-shaped member having a predetermined shape, and a punching process is performed at a predetermined position. Next, press work (drawing press work) is carried out for the substantially disc-shaped member subjected to press-punching so as to erect and form the small blade 42 and so as to extrude and form the projection 44. Next, a hardening process is performed. Thereafter, the blade edge of the small blade 42 is subjected to grinding or polishing. Then, the blade edge of the small blade 42 is subjected to a machining process such as finishing work (rubbing and polishing).

In this case, the projection 44 is configured to have a predetermined shaped through-hole 46 which penetrates in the vertical direction (axial direction) at the center position in the radial direction. As a result of intensive research, the present inventor found that forming the shape of the above-described characteristic inner blade can be realized through press work by providing the through-hole 46 for the projection 44 at the center position in the radial direction. That is, in a case where the through-hole is not provided, it was difficult to form the projection 44 so that the convex portion 44*a* has a desired height or so that the concave portion 44*b* has a desired depth. As an example, the through-hole 46 employs a circular hole whose center axis is coaxial with the rotary shaft (center axis) of the inner blade 40, but a configuration is not limited thereto.

Second Embodiment

Subsequently, the rotary electric shaver 1 according to a second embodiment of the present invention will be described. The rotary electric shaver 1 according to the present embodiment has a basic configuration which is the same as that according to the above-described first embodiment. However, there is a different point in a fitting configuration between the inner blade 40 and the outer blade assembly 4. Hereinafter, the different point of the present embodiment will be mainly described.

Figure 11:
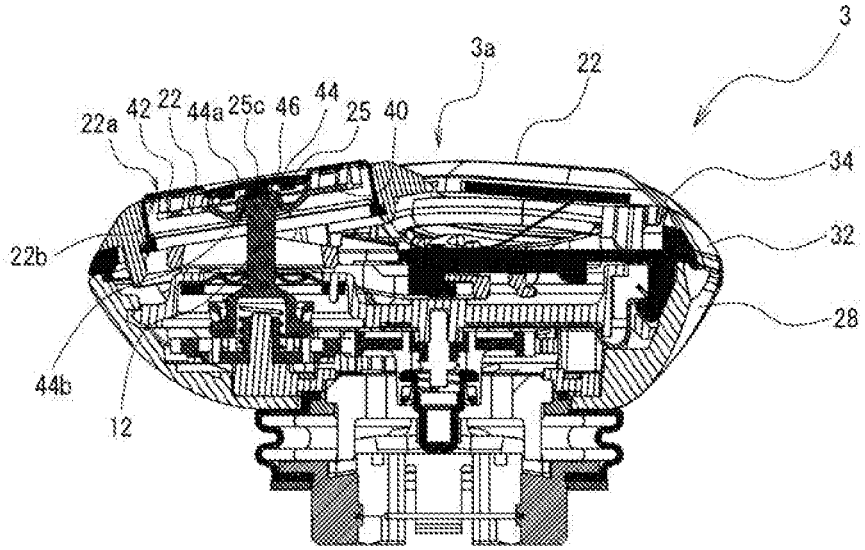
FIG. 11 is a schematic view (side sectional view) illustrating an example of a head unit of a rotary electric shaver according to a second embodiment of the present invention.

A configuration of the outer blade cover 25 of the outer blade assembly 4 according to the present embodiment is different from that according to the first embodiment. Specifically, as illustrated by a side sectional view (schematic view) of the head unit 3 in FIG. 11, a configuration is adopted in which a cylindrical projection portion 25*c* is disposed at the center position in the radial direction on the lower surface side of the outer blade cover 25.

According to this configuration, the cylindrical projection portion 25*c* which is erected in the axial direction on the lower surface side of the outer blade cover 25 is internally fitted into the circular through-hole 46 disposed in the projection 44 of the inner blade 40. In this manner, in a state where the center of the inner blade 40 is aligned with the center of the outer blade cover 25, both of these are restrained from moving in the radial direction (positioned), and are fitted to each other. Therefore, in a state where the center of the inner blade 40 is aligned with the center of the outer blade assembly 4, both of these are restrained from moving in the radial direction (positioned), and the inner blade 40 is rotatable with respect to the outer blade assembly 4. In this case, the inner blade 40 is movable in the vertical direction with respect to the outer blade cover 25.

As described above, the rotary electric shaver according to the present invention, the inner blade assembly configured to include at least two components in the related art can be configured to include a single component of only the inner blade. Therefore, the number of components can be half decreased, and it is possible to eliminate a process for assembling the multiple components and assembly equipment required for the process. Therefore, it is possible to greatly decrease component cost and manufacturing cost.

Furthermore, whereas the height of the inner blade assembly in the related art is inevitably increased due to the configuration including two components, it is possible to minimize the dimension in the height direction (axial direction). Therefore, in particular, the head unit for accommodating the inner blade can be formed so as to have a compact size, and a configuration can be more freely designed.

In addition, according to the method of manufacturing the inner blade of the rotary electric shaver in the present invention, manufacturing (forming) a single component (rotor) functioning as an integral structure formed of a metal material, that is, the inner blade including the predetermined projection portion at the center position in the radial direction, can be realized through press work.

The present invention is not limited to the above-described embodiments, and can be modified in various ways within the scope not departing from the present invention. In particular, an example has been described in which the rotary electric shaver has three sets of the dual track structure combination (blade unit) between the outer blade and the inner blade. However, the present invention is not limited thereto.

What is claimed is:

1. A rotary electric shaver comprising:

wherein the rotary electric shaver is in an upright position; an outer blade whose upper surface functions as annular shaving surfaces having multiple hair inlets formed therein; and an inner blade operatively positioned within the outer blade for rotation and being in slidable contact with a lower surface of the outer blade from below the annular shaving surfaces, wherein the inner blade, including a centrally formed recessed portion, a projection and a concave portion, is an integral structure using a metal material, and includes an inner blade base plate having the centrally formed recessed portion extending downwardly from the inner blade base plate with the projection extending upwardly from a center position of the recessed portion, said projection including an upper surface side defining a convex portion and a lower surface side defining the concave portion at the center position in a radial direction, wherein an upper end portion of an inner blade drive shaft directly engages with the concave portion so as to be disengageable therefrom, wherein the projection extends upwardly from a position located under a plate surface of an inner blade base plate by forming the recessed portion around the projection, wherein a shape of the concave portion is polygonal shaped, wherein a through-hole is formed at a radial center of the concave portion, wherein a side portion of the concave portion has a curvature in an axial direction, and wherein an upper end portion of the drive shaft has a shape corresponding to the shape of the concave portion and engages with the concave portion.

2. The rotary electric shaver according to claim 1, wherein the convex portion engages with the outer blade or an outer blade cover fitted to the outer blade so as to be movable in an axial direction and so as to be immovable in the radial direction.

3. The rotary electric shaver according to claim 2, wherein the convex portion engages with the outer blade or a cylindrical portion disposed on a lower surface side of the outer blade cover, in an internally fitting arrangement.

4. The rotary electric shaver according to claim 3, wherein the convex portion has three or more corner portions which come into slidable contact with an inner wall of the cylindrical portion.

5. The rotary electric shaver according to claim 2, wherein the projection has a through-hole which is coaxial with a rotation center axis of the inner blade.

6. The rotary electric shaver according to claim 5, wherein the outer blade or a projection portion disposed on a lower surface side of the outer blade cover engages with the through-hole in an internally fitting arrangement.

* * * * *